US006631347B1

(12) United States Patent
Kim et al.

(10) Patent No.: US 6,631,347 B1
(45) Date of Patent: Oct. 7, 2003

(54) VECTOR QUANTIZATION AND DECODING APPARATUS FOR SPEECH SIGNALS AND METHOD THEREOF

(75) Inventors: Moo Young Kim, Stockholm (SE); Willem Bastiaan Kleijn, Stocksund (SE)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/234,182

(22) Filed: Sep. 5, 2002

(30) Foreign Application Priority Data

May 8, 2002 (KR) ..... 2002-25401

(51) Int. Cl.[7] ..... G10L 19/12
(52) U.S. Cl. ..... 704/222; 704/219
(58) Field of Search ..... 704/222, 219

(56) References Cited

U.S. PATENT DOCUMENTS

| | | | | | |
|---|---|---|---|---|---|
| 4,907,276 | A | * | 3/1990 | Aldersberg | 704/222 |
| 5,544,277 | A | * | 8/1996 | Bakis | 704/211 |
| 5,950,155 | A | * | 9/1999 | Nishiguchi | 704/230 |
| 6,151,414 | A | * | 11/2000 | Lee et al. | 382/253 |
| 6,389,388 | B1 | * | 5/2002 | Lin | 704/219 |
| 6,415,254 | B1 | * | 7/2002 | Yasunaga | 704/223 |

OTHER PUBLICATIONS

Dony, R. D. and Haykin, S. "Neural network approaches to image compression," Proceedings of the IEEE, vol. 83, Issue 2, p 288–303, Feb. 1995.*

Kim, Tae–Yong et al. "KLT–based adaptive vector quantization using PCNN," IEEE International Conference on Systems, Ma and, Cybernetics, vol. 1, pp. 82–87, Oct. 1996.*

* cited by examiner

*Primary Examiner*—Richemond Dorvil
*Assistant Examiner*—Kinari Patel
(74) *Attorney, Agent, or Firm*—Burns, Doane, Swecker & Mathis, L.L.P.

(57) ABSTRACT

A vector quantizing apparatus, a decoding apparatus, a vector quantization method, and a decoding method are provided. Upon encoding of a speech signal by the vector quantization apparatus and method, the advantages of vector quantization are maximized by quantizing the speech signal using KLT-based classified codebooks and the eigenvalues and eigenvectors of the speech signal. The vector quantization apparatus includes a codebook group, a Karhunen-Loéve Transform (KLT) unit, first and second selection units and a transmission unit. The codebook group has a plurality of codebooks that store the code vectors for a speech signal, and the codebooks are classified using KLT domain statistics for the speech signal. The KLT unit transforms an input speech signal to a KLT domain. The first selection unit selects an optimal codebook from the codebooks in the codebook group on the basis of the eigenvalue set of the covariance matrix of the input speech signal obtained by KLT. The second selection unit determined the distortion between each of the code vectors in the selected codebook and the speech signal transformed to a KLT domain by the KLT unit and selects an optimal code vector on the basis of the determined distortion. The transmission unit transmits the optimal code vector so that the index of the optimal code vector is used as to reconstruct the KL-transformed input speech signal. The decoding apparatus includes a data detection unit, a codebook group, and an inverse KLT unit, and restores the original speech signal from the vector-quantized speech signal.

19 Claims, 5 Drawing Sheets

VECTOR QUANTIZATION AND DECODING APPARATUS FOR SPEECH SIGNALS AND METHOD THEREOF

CROSS-REFERENCE TO RELATED APPLICATIONS

This application is based upon and claims priority from Korean Patent Application No. 2002-25401 filed May 8, 2002, the contents of which are incorporated herein by reference.

BACKGROUND OF THE INVENTION

1. Field of the Invention

The present invention relates to coding technology for speech signals, and more particularly, to a vector quantization and decoding apparatus providing high encoding efficiency for speech signals and method thereof.

2. Description of the Related Art

To obtain low-bit-rate coding capable of preventing degradation of the quality of sound, vector quantization is preferred over scalar quantization because the former has memory, space-filling and shape advantages.

Conventional vector quantization technique for speech signals includes direct vector quantization (hereinafter, referred to as DVQ) and the code-excited linear prediction (hereinafter, referred to as CELP) coding technique.

If the signal statistics are given, DVQ provides the highest coding efficiency. However, the time-varying signal statistics of a speech signal require a very large number of codebooks. This makes the storage requirements of DVQ unmanageable.

CELP uses a single codebook. Thus, CELP does not require large storage like DVQ. The CELP algorithm consists of extracting linear prediction (hereinafter, referred to as LP) coefficients from an input speech signal, constructing from the code vectors stored in the codebook trial speech signals using a synthesis filter whose filtering characteristic is determined by the extracted LP coefficients, and searching for the code vector with a trial speech signal most similar to that of the input speech signal.

For CELP, the Voronoi-region shape of the code vectors stored in the codebooks may be nearly spherical, as shown in FIG. 1A for the two-dimensional case, while the trial speech signals constructed by a synthesis filter do not have a spherical Voronoi-region shape, as shown in FIG. 1B. Therefore, CELP does not sufficiently utilize the space-filling and shape advantages of vector quantization.

SUMMARY OF THE INVENTION

To solve the above-described problems, it is an objective of the present invention to provide a vector quantization and decoding apparatus and method that can sufficiently utilize the VQ advantages upon coding of speech signals.

Another objective of the present invention is to provide a vector quantization and decoding apparatus and method in which an input speech is quantized with modest calculation and storage requirements, by vector-quantizing a speech signal using code vectors obtained by the Karhunen-Loéve Transform (KLT).

Still another objective of the present invention is to provide a KLT-based classified vector and decoding apparatus by which the Voronoi-region shape for a speech signal is kept nearly spherical, and a method thereof.

In order to achieve the above objectives, the present invention provides a vector quantization apparatus including a codebook group, a KLT unit, first and second selection units, and a transmission unit. The codebook-group has a plurality of codebooks that store the code vectors for a speech signal obtained by KLT, and the codebooks are classified according to KLT-domain statistics of the speech signal. The KLT unit transforms an input speech signal to a KLT domain. The first selection unit selects an optimal codebook from the codebooks on the basis of the eigenvalue set for the covariance matrix of the input speech signal obtained by the KLT. The second selection unit selects an optimal code vector on the basis of the distortion between each of the code vectors carried on the selected codebook and the speech signal transformed to a KLT domain by the KLT unit. The transmission unit transmits the index of the optimal code vector to the decoding side so that the optimal code vector is used as the data of vector quantization for the input speech signal.

Each codebook is associated with a signal class on the basis of the eigenvalues of the covariance matrix of the speech signal. The KLT unit performs the following operations. First, the KLT unit calculates the linear prediction (LP) coefficient of the input speech signal, obtains a covariance matrix using the LP coefficients, and calculates a set of eigenvalues for the covariance matrix and eigenvectors corresponding to the eigenvalues. Then, the KLT unit obtains an eigenvalue matrix based on the eigenvalue set and also a unitary matrix on the basis of the eigenvectors. Thereafter, the KLT unit obtains a KLT domain representation for the input speech signal using the unitary matrix.

Preferably, the first selection unit selects a codebook with an eigenvalue set similar to the eigenvalue set calculated by the KLT unit. Preferably, the second selection unit selects a code vector having a minimum distortion value so that the code vector used is the optimal code vector.

In order to achieve the above objectives, the present invention also provides a vector quantization method for speech signals in a system including a plurality of codebooks that store the code vectors for a speech signal. According to this method, an input speech signal is transformed to a KLT domain. A codebook corresponding to the input speech signal is selected from the codebooks on the basis of the eigenvalue set of the covariance matrix of the input speech signal detected according to the KLT of the input speech signal. An optimal code vector is selected on the basis of the distortion value between each of the code vectors stored in the selected codebook and the KL-transformed speech signal. The selected code vector is transmitted so that it is used as a vector quantization value for the input speech signal.

The KLT-based transformation of an input speech signal is performed by the following steps. First, the LP coefficients of the input speech signal are estimated. Then, the covariance matrix for the input speech signal is obtained, and the eigenvalues for the covariance matrix and the eigenvectors for the eigenvalues are calculated. The unitary matrix for the speech signal is also obtained using the eigenvector set. The input speech signal is transformed to a KLT domain using the unitary matrix.

Preferably, the selected codebook is a codebook that corresponds to an eigenvalue set similar to the estimated eigenvalue set. Preferably, a code vector having a minimum distortion is selected as the optimal code vector.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1A:
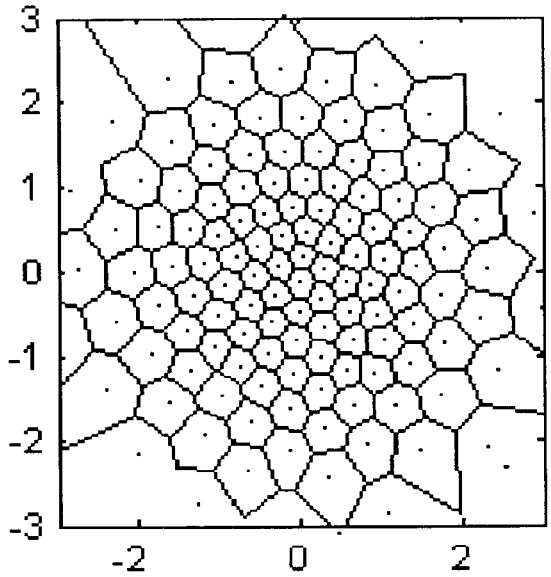
FIG. 1A shows the Voronoi-region shape of an example CELP codebook in the residual domain.
Figure 1B:
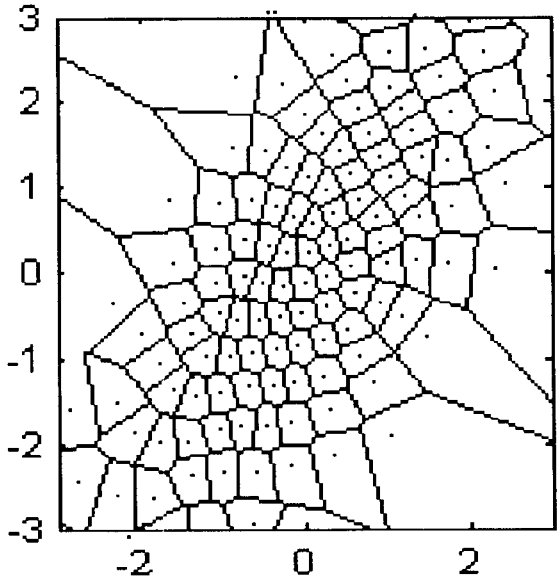
FIG. 1B shows the Voronoi-region shape of the corresponding CELP codebook in the speech domain.
Figure 2:
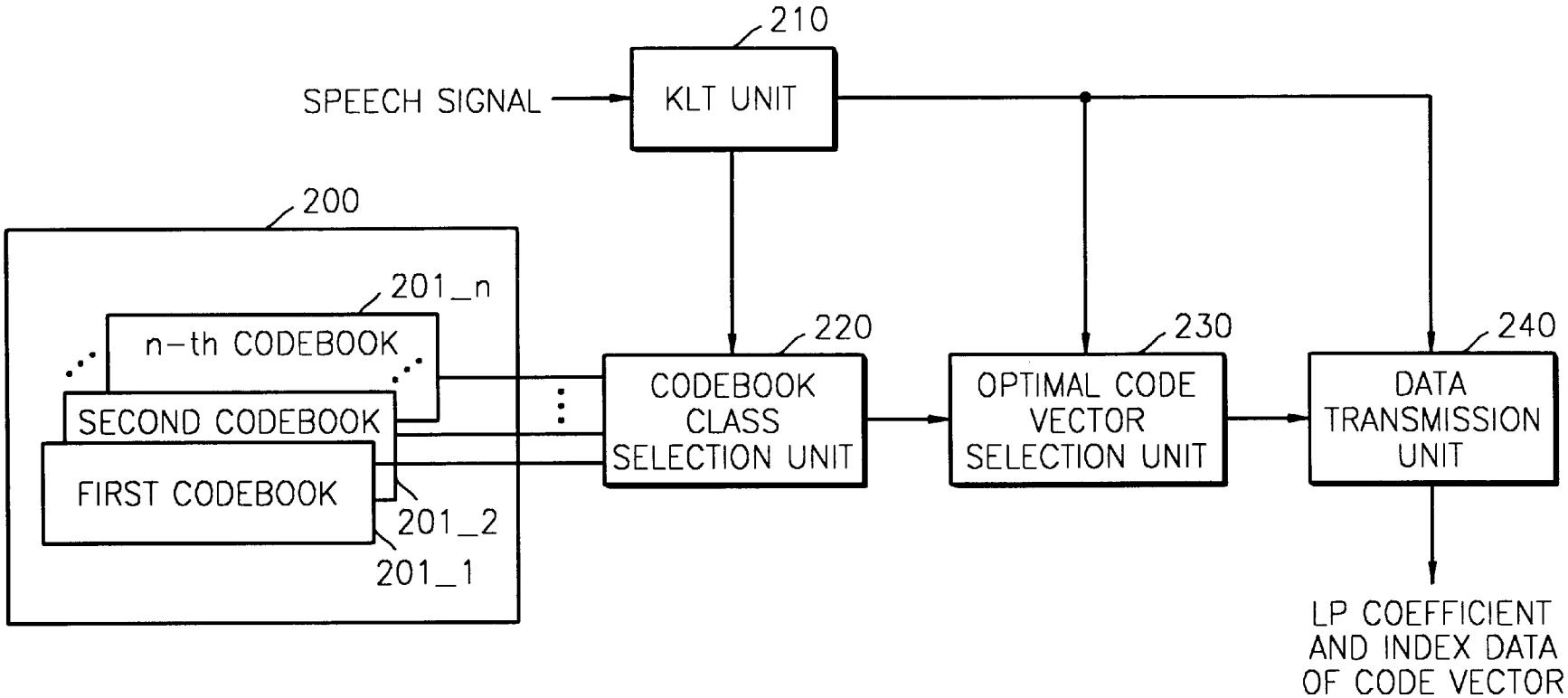
FIG. 2 is a block diagram showing a vector quantization apparatus according to the present invention.

Referring to FIG. 2, a vector quantization apparatus for speech signals according to the present invention includes a codebook group 200, a Karhunen-Loéve Transform (KLT) unit 210, a codebook class selection unit 220, an optimal code vector selection unit 230 and a data transmission unit 240.

The codebook group 200 is designed so that codebooks are classified according to the narrow class of KLT-domain statistics for a speech signal using the KLT energy concentration property in the training stage.

Figure 3A:
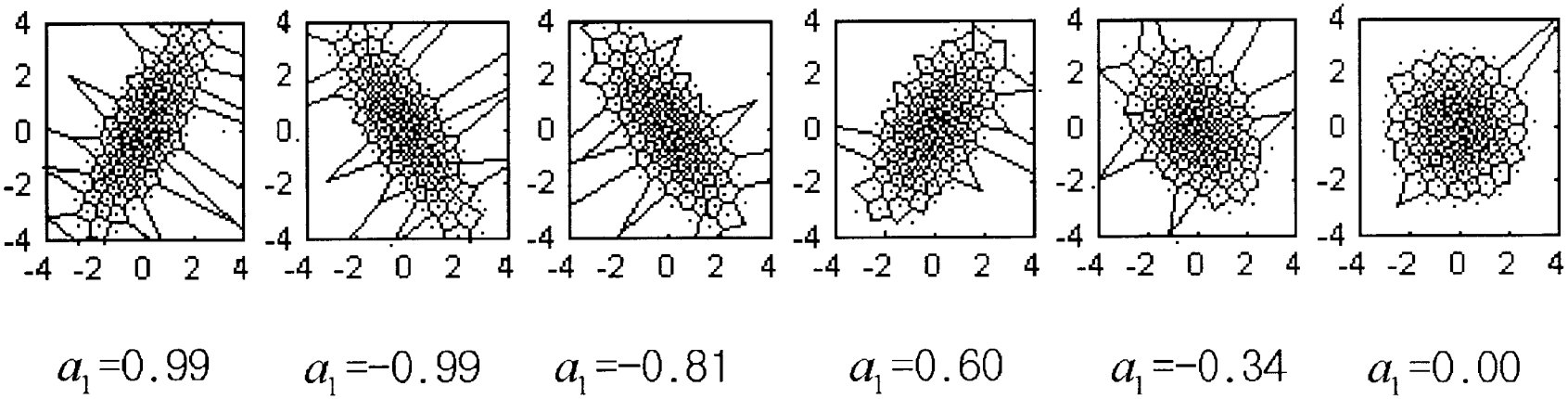
FIGS. 3A and 3B show examples of a Voronoi-region to explain KLT characteristics.
Figure 3B:
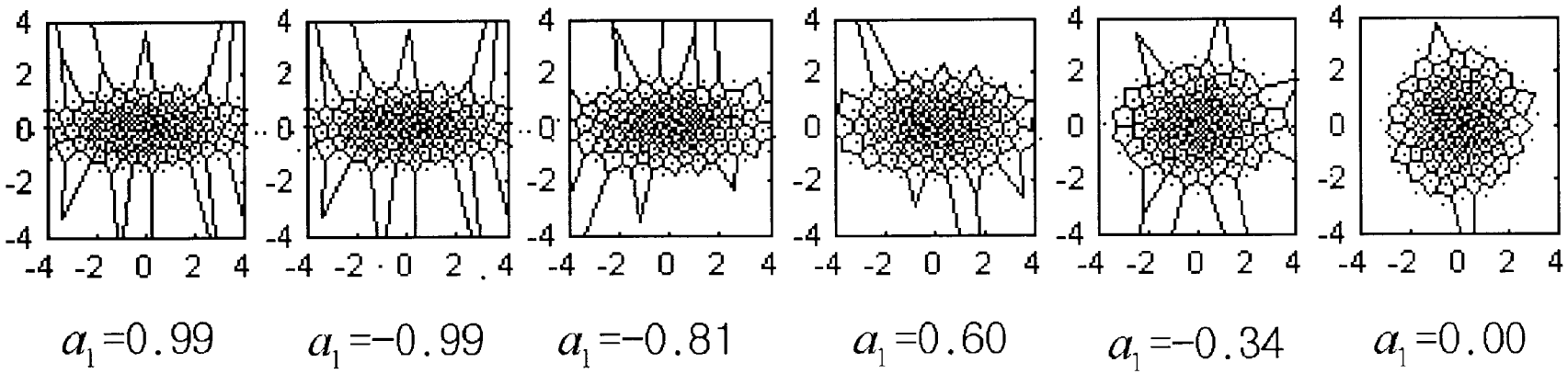

That is, when a speech signal is transformed to a KLT-domain, we obtain domains whose energy concentrated along the horizontal axis, as shown in FIG. 3B. FIG. 3A shows the distribution of code vectors for a 2-dimensional speech signal for each correlation coefficient $a_1$. FIG. 3B shows the distribution code vectors for a KL-transformed signal corresponding to the 2-dimensional speech signal for a correlation coefficient $a_1$ as shown in FIG. 3A. We note from FIG. 3B that speech signals having different statistics have identical statistics in the KLT-domain. Having identical statistics in the KLT-domain implies that speech signals can be classified into an identical eigenvalue set. The eigenvalue corresponds to a variance of the component of a vector transformed to a KLT-domain. A distance measure can be used to classify the speech signal into one of n classes, corresponding to the first to n-th codebooks 201_1 to 201_n included in the codebook group 200. This is done by finding the eigenvalue set having most similar statistics.

The eigenvalue set can be advantageously classified using the distance measure shown in the following Equation 1:

$$\epsilon' = \sum_{i=1}^{k} \left( \sqrt{\lambda_i} - \sqrt{\overline{\lambda_i^j}} \right)^2 \tag{1}$$

wherein $\overline{\lambda_i^j}$ is the i-th eigenvalue of the codebook in the j-th class and $\lambda_i$ is the i-th eigenvalue of the input signal.

That is, one codebook has two eigenvalues if code vectors for a 2-dimensional signal are considered. If code vectors for a k-dimensional signal are considered, the corresponding codebook has k eigenvalues. The 2 eigenvalues and the k eigenvalues are referred to as eigenvalue sets corresponding to the respective codebooks. As described above, when codebooks are classified by eigenvalue sets, higher eigenvalues are more important.

The code vectors included in the first to n-th codebooks 201_1 to 201_n are quantized speech signals transformed to the KLT-domain. Eigenvalues corresponding to the energy of speech signals are normalised as shown in Equation 2:

$$\lambda_i' = \lambda_i \Big/ \sum_{j=1}^{k} \lambda_j (i = 1, \ldots, k) \tag{2}$$

Then, the normalised eigenvalues are applied to Equation 1.

The class eigenvalue sets are estimated from the P-th order LP coefficients of actual speech data, and quantized using the Linde-Buzo-Gray (LBG) algorithm having a distance measuring function as shown in Equation 1. Here, P can be 10, for example. The more classes of codebooks are included in the codebook group 200, the more the SNR efficiency of a vector quantization apparatus for speech signal improves.

The KLT unit 210 transforms an input speech signal to the KLT-domain frame by frame. In order to perform transformation, the KLT unit 210 obtains LP coefficients by analysing an input speech signal. The obtained LP coefficient is transmitted to the data transmission unit 240. The LP coefficient of the input speech signal is obtained by one of conventional known methods. The covariance matrix E(x) of the input speech signal is obtained using the obtained LP coefficients. For the 5-dimensional case, the covariance matrix E(x) is defined as the following Equation 3:

$$\begin{bmatrix} 1 & A_1 & A_2 & A_3 & A_4 \\ A_1 & 1 + A_1^2 & A_1 + A_1A_2 & A_2 + A_1A_3 & A_3 + A_1A_4 \\ A_2 & A_1 + A_1A_2 & 1 + A_1^2 + A_2^2 & A_1 + A_1A_2 + A_2A_3 & A_2 + A_1A_3 + A_2A_4 \\ A_3 & A_2 + A_1A_3 & A_1 + A_1A_2 + A_2A_3 & 1 + A_1^2 + A_2^2 + A_3^2 & A_1 + A_1A_2 + A_2A_3 + A_3A_4 \\ A_4 & A_3 + A_1A_4 & A_2 + A_1A_3 + A_2A_4 & A_1 + A_1A_2 + A_2A_3 + A_3A_4 & 1 + A_1^2 + A_2^2 + A_3^2 + A_4^2 \end{bmatrix} \tag{3}$$

wherein $A_1=a_1$, $A_2=a_1^2+a_2$, $A_3=a_1^3+2a_1a_2+a_3$, and $A_4=a_1^4+3a_1^2a_2+2a_1a_3+a_2^2+a_4$. $a_1$ to $a_4$ are LP coefficients. Thus, the covariance matrix (E(x)) is calculated using the LP coefficients.

Then, the KLT unit 210 calculates the eigenvalue $\lambda_i$ for the covariance matrix E(x) using Equation 4, and calculates eigenvector $P_i$ using Equation 5:

$$|E(x)-\lambda_i I|=0 \tag{4}$$

$$(E(x)-\lambda_i I)P_i=0 \tag{5}$$

wherein I is an identity matrix in which the diagonal matrix values are all 1 and the other values are all 0. The eigenvector satisfying Equation 5 is normalized.

Matrix D is obtained by arranging the ordered eigenvalues of the covariance matrix E(x), $D=[\lambda_1,\lambda_2, \ldots, \lambda_k]$. Matrix D is output to the codebook class selection unit 220.

The KLT unit 210 obtains a unitary matrix U using the obtained eigenvectors by Equation 6

$$U=[P_1,P_2, \ldots, P_k] \tag{6}$$

wherein $P_1$, $P_2$ and $P_k$ are k×1matrices.

The input speech signal is transformed to the KLT-domain through the multiplication of the input speech signal $s^k$ by $U^T$, $U^Ts^k$. Here $S^k$ can be a k-dimensional original speech itself or a zero state response (ZSR) of an LP synthesis filter. The speech signal transformed to the KLT-domain is provided to the optimal code vector selection unit 230. The superscript T is the transpose, and $s^k$ is a k-dimensional vector of the speech signal.

The codebook class selection unit 220 selects a corresponding codebook from the first to n-th codebooks 201_1 to 201_n on the basis of the matrix D received from the KLT unit 210. That is, the codebook class selection unit 220 selects a codebook having eigenvalues (or an eigenvalue set) most similar to the matrix D received from the KLT unit 210, according to Equation 1. If the selected codebook is the first codebook 201_1, the code vectors included in the first codebook 201_1 are sequentially output to the optimal code vector selection unit 230. If the codebook class selection unit 220 receives the eigenvalues instead of the matrix D from the KLT unit 210, it may select an optimal codebook using Equation 1.

The optimal code vector selection unit 230 calculates the distortion between $U^Ts^k$ received from the KLT unit 210 and each of the code vectors received from the codebook class selection unit 220 as shown in Equation 7:

$$\epsilon'=(U^Ts^k-\hat{c}_{ij}^k)^T(U^Ts^k\hat{c}_{ij}^k) \tag{7}$$

wherein $\hat{c}_{ij}^k$ denotes a j-th codebook entry in the i-th class for $U^Ts^k$. Based on the calculated distortion values, the optimal code vector selection unit 230 extracts the optimal code vector having a minimum distortion. The optimal code vector selection unit 230 transmits the index data of the selected code vector to the data transmission unit 240.

Figure 4:
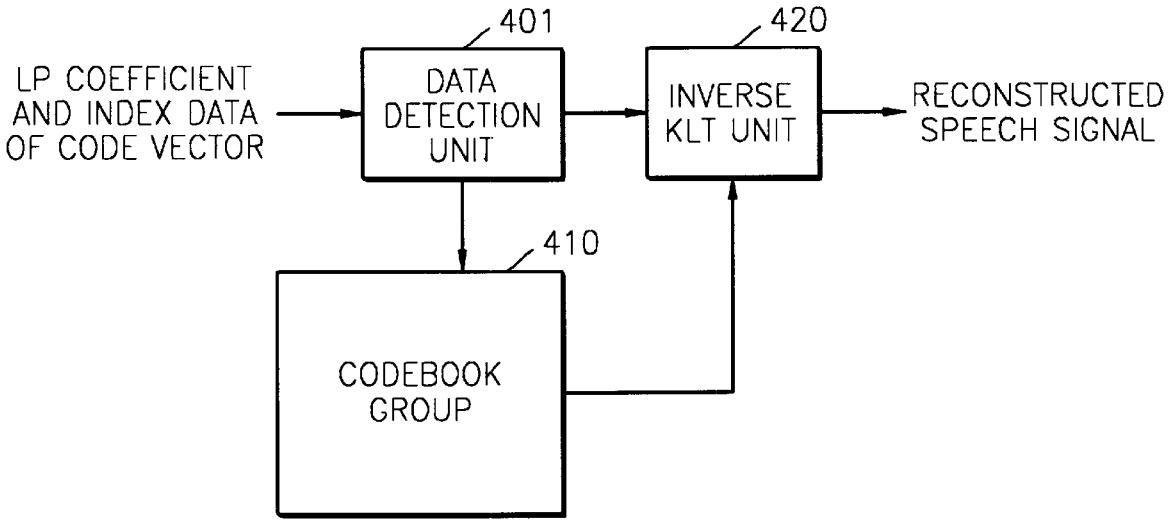
FIG. 4 is a block diagram showing a decoding apparatus corresponding to the vector quantization apparatus of FIG. 2.

The data transmission unit 240 transmits the frame-by-frame LP coefficient from the KLT unit 210 and the index data of the selected code vector to a decoding system including a decoding apparatus shown in FIG. 4.

Referring to FIG. 4, the decoding apparatus corresponding to the vector quantization apparatus of FIG. 2, includes a data detection unit 401, a codebook group 410, and an inverse KLT unit 420. The data detection unit 401 detects the index data of a code vector from the data received from an encoding system including the vector quantization apparatus of FIG. 2, and obtains a matrix D and a unitary matrix U from a received LP coefficient using Equations 3 to 6. The matrix D and the detected code vector index data are transferred to the codebook group 410, and the unitary matrix U is transferred to the inverse KLT unit 420.

The codebook group 410 selects a codebook class using the received matrix D and detects the optimal code vector from the selected codebook class using the received code vector index data. The codebook group 410 is composed of codebooks organized in the same fashion as the codebook group 200 of FIG. 2, and transfers the optimal code vector corresponding to the matrix D and the code vector index data to the inverse KLT unit 420.

The inverse KLT unit 420 restores the original speech signal corresponding to the selected code vector in the inverse way of the transformation by the KLT unit 210 using the unitary matrix U from the data detection unit 401 and the code vector from the codebook group 410. That is, the code vector is multiplied by U, and the original speech signal is restored.

The vector quantization apparatus and the decoding apparatus can exist within a system if a coding system and a decoding system are formed in one body.

Figure 5:
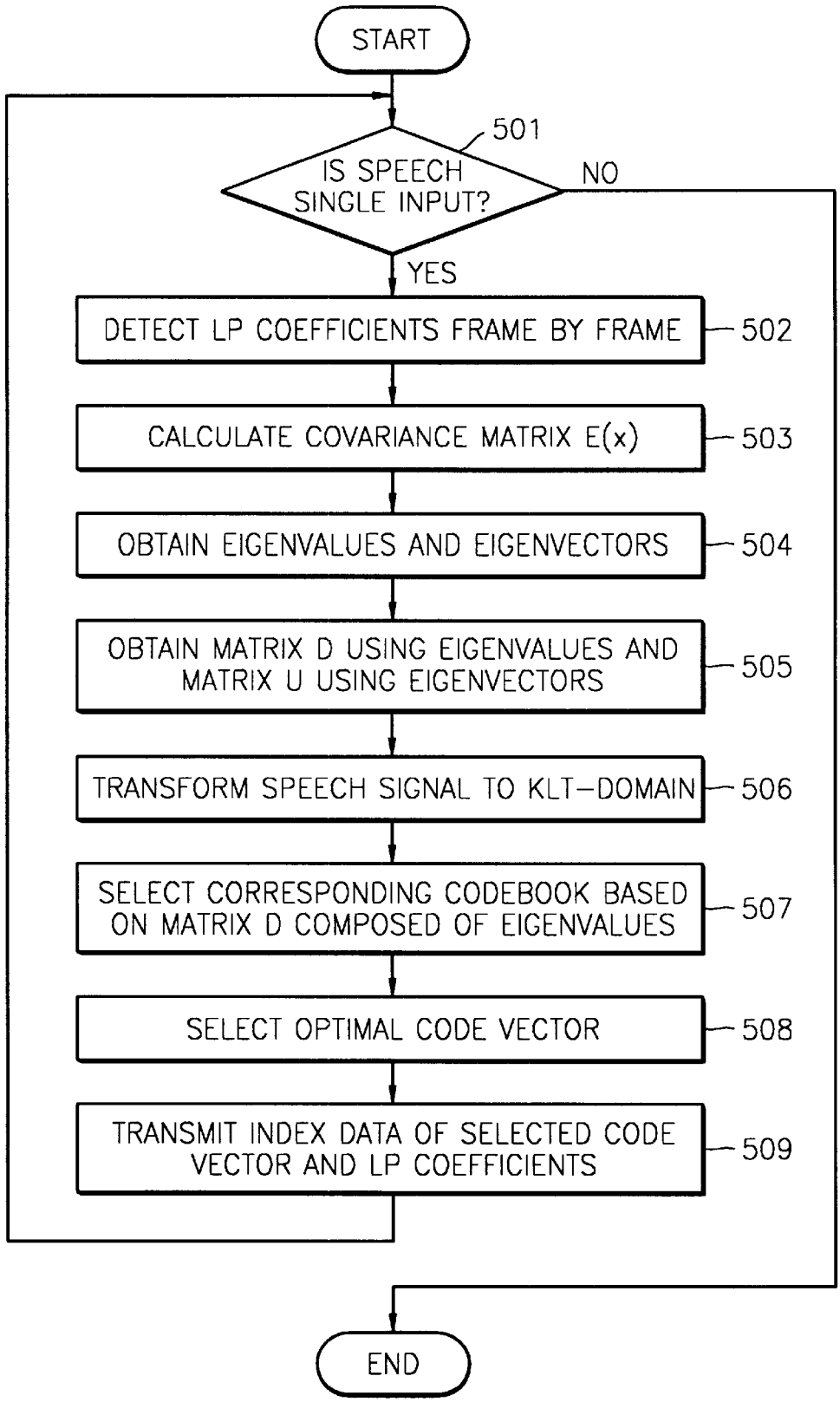
FIG. 5 is a flowchart illustrating the steps of a vector quantization method according to the present invention.

FIG. 5 is a flowchart illustrating the steps of KLT-based classified vector quantization. Referring to FIG. 5, if it is determined in step 501 that a speech signal is input, the LP coefficients for the. input speech signal are estimated frame by frame, in step 502. In step 503, the covariance matrix E(x) of the input speech signal is calculated as in Equation 3. In step 504, an eigenvalue for the input speech signal is calculated using the calculated covariance matrix E(x), and an eigenvector is calculated using the obtained eigenvalue.

In step 505, a matrix D is obtained using the eigenvalues, and a matrix U is obtained using the eigenvectors. The matrices D and U are calculated in the same way as described above for the KLT unit 210 of FIG. 2. In step 506, the input speech signal is transformed to the KLT-domain using the matrix UThe steps 502 to 506 can be defined as the process of transforming the input speech signal to the KLT-domain.

In step 507, a corresponding codebook is selected from a plurality of codebooks using the matrix D composed of eigenvalues. The plurality of codebooks are classified on the basis of the speech signal transformed to the KLT-domain as described above for the codebook group 200 of FIG. 2.

In step 508,an optimal code vector is selected by substituting into Equation 7 the code vectors included in the selected codebook and the KL-transformed speech signal $U^Ts^k$ obtained through the steps 502 to 506. The optimal code vector is a code vector having the minimum value out of the result values calculated through Equation 7.

In step 509, the index data of the selected code vector and the LP coefficients estimated in step 502 are transmitted to be the result values of vector quantization for the input speech signal.

If it is determined in step 501 that there is no input signal, the process is not carried out.

The index data of the code vector and the LP coefficients, which are transmitted to the decoder in step 509, are decoded, and the decoded data is subject to an inverse KLT operation. Through such a process, the speech signalis restored.

FIG. 5 shows an example of the selection of an optimal codebook class using the matrix D as described above in FIG. 2. The optimal codebook class is selected using the eigenvalues of the matrix D and Equation 1.

In the above-described embodiment, the LP coefficient and the code vector index data are both considered as the result of the vector quantization with respect to a speech signal. However, only the code vector index data may be transferred as the result of the vector quantization. In the backward adaptive manner, which is similar to the backward adaptive LP coefficient estimation method used in the ITU-T G.728 standard, a decoding side estimates the LP coefficient representing the spectrum characteristics of a current frame from a speech signal quantized at the previous frame. As a result, an encoding side does not need to transfer an LP parameter to the decoding side. Such LP estimation can be achieved because the speech spectrum characteristics change slowly.

If the encoding side does not transfer an LP coefficient to the decoding side, the LP coefficient applied to the data detection unit 401 of FIG. 4 is not received from the encoding system but estimated by the decoding side in the above-described backward adaptive manner.

The present invention proposes a KLT-based classified vector quantization (CVQ), where the space-filling advantage can be utilized since the Voronoi-region shape is not affect by the KLT. The memory and shape advantage can be also used, since each codebook is designed based on a narrow class of KLT-domain statistics. Thus, the KLT-based classified vector quantization provides a higher SNR than CELP and DVQ.

In the present invention, because the KLT does not change the Voronoi-region shape (while the LP filter does), the input signal is transformed to a KLT-domain and the best code vector is found. This process does not require an additional LP synthesis filtering calculation of code vectors during the codebook search. Thus, the KLT-based classified vector quantization has a codebook search complexity similar to DVQ and much lower than CELP.

In the present invention, the KLT results in relatively low variance for the smallest eigenvalue axes, which facilitates a reduced memory requirement to store the codebook and a reduced search complexity to find the proper code vector. This advantage is obtained by considering a subset dimension having only high eigenvalues. As an illustrative example, for a 5-dimensional vector, by using the four largest eigenvalues axes, comparable performance with the usage of all axes can be obtained. Thus, by exploiting the energy concentration property of the KLT, the storage requirements and the search complexity can be reduced.

While this invention has been particularly shown and described with reference to a preferred embodiment thereof, it will be understood by those skilled in the art that various changes in form and details may be made therein without departing from the spirit and scope of the invention as defined by the appended claims.

What is claimed is:

1. A vector quantization apparatus for speech signals, comprising:

a codebook group having a plurality of codebooks that store the code vectors for a speech signal obtained by Karhunen-Loéve Transform (KLT), the codebooks classified according to the KLT domain statistics of the speech signal;

a KLT unit for transforming an input speech signal to a KLT domain;

a first selection unit for selecting an optimal codebook from the codebooks included in the codebook group, on the basis of the eigenvalues for the input speech signal obtained by KLT;

a second selection unit for selecting an optimal code vector on the basis of the distortion between each of the code vectors in the selected codebook and the speech signal transformed to a KLT domain by the KLT unit; and a transmission unit for transmitting the index of optimal code vector so that the optimal code vector is used as the data of vector quantization for the input speech signal.

2. The vector quantization apparatus of claim 1, wherein each codebook is associated with a signal class of the eigenvalues of the covariance matrix of the speech signal.

3. The vector quantization apparatus of claim 1, wherein the KLT unit performs the following operations:

calculating the linear prediction (LP) coefficients of the input speech signal;

obtaining a covariance matrix based on the LP coefficients;

calculating the eigenvalues of the covariance matrix;

obtaining an eigenvector set corresponding to the eigenvalue set;

obtaining a unitary matrix on the basis of the eigenvector set; and obtaining a KLT domain representation for the input speech signal using the unitary matrix.

4. The vector quantization apparatus of claim 1, wherein the first selection unit selects the optimal codebook using the following equation:

$$\epsilon' = \sum_{i=1}^{k} \left( \sqrt{\lambda_i} - \sqrt{\overline{\lambda_i^j}} \right)^2$$

wherein $\overline{\lambda_{ij}}$ is the i-th eigenvalue of the j-th class codebook and $\lambda_i$ is the i-th eigenvalue of the input signal.

5. The vector quantization apparatus of claim 1, wherein the first selection unit selects a codebook to which an eigenvalue set similar to the eigenvalue set calculated by the KLT unit is allocated, to serve as the optimal codebook.

6. The vector quantization apparatus of claim 1, wherein the second selection unit selects a code vector having a minimum distortion value so that the code vector is the optimal code vector.

7. The vector quantization apparatus of claim 1, wherein the second selection unit detects the distortion using the following equation:

$$\epsilon' = (U^T s^k - \hat{c}_{ij}^{\,k})^T (U^T s^k - \hat{c}_{ij}^{\,k})$$

wherein $U^T s^k$ is a k-dimensional KLT-domain signal and $\hat{c}_{ij}^{\,k}$ denotes a j-th codebook entry in the i-th class for $U^T s^k$.

8. The vector quantization apparatus of claim 1, wherein the transmission unit transmits both index data of the selected code vector and index of LP coefficients as the data of encoding for the input speech signal.

9. The vector quantization apparatus of claim 1, wherein the dimension of the codebook is reduced to a subset dimension by using the energy concentration property of the KLT.

10. The vector quantization apparatus of claim 1, wherein, if the LP coefficient representing the spectrum characteristics of a current frame can be estimated from a speech signal quantized at the previous frame, the transmission unit is constructed so as not to transmit LP coefficients as the data of vector quantization for the input speech signal.

11. A vector quantization method for speech signals in a system having a plurality of codebooks that store the code vectors for a speech signal, the method comprising the steps of:

transforming an input speech signal to a Karhunen-Loéve Transform (KLT) domain;

selecting an optimal codebook from the codebooks on the basis of an eigenvalue set for the input speech signal, the eigenvalue set estimated by the transformation of the input speech signal into a KLT domain;

selecting an optimal code vector on the basis of the distortion value between each of the code vectors stored in the selected codebook and the speech signal transformed into a KLT domain; and transmitting an index data of the selected code vector to serve as a vector quantization value for the input speech signal.

12. The vector quantization method of claim 11, wherein the KLT step includes the substeps of:

estimating the linear prediction (LP) coefficient of the input speech signal;

obtaining the covariance matrix for the input speech signal;

calculating the eigenvalue set for the covariance matrix;

calculating the eigenvector set for the eigenvalue set;

obtaining the unitary matrix for the speech signal using the eigenvector set; and transforming the input speech signal to a KLT domain using the unitary matrix.

13. The vector quantization method of claim 12, wherein, if the LP coefficient representing the spectrum characteristics of a current frame can be estimated from a speech signal quantized at the previous frame, LP coefficients are not transmitted as the data of encoding for the input speech signal.

14. The vector quantization method of claim 11, wherein, in the codebook selection step, a codebook associated with an eigenvalue set similar to the eigenvalue set is selected as the optimal codebook using $$\epsilon' = \sum_{i=1}^{k} \left( \sqrt{\lambda_i} - \sqrt{\overline{\lambda_i^j}} \right)^2$$

wherein $\lambda_i$ is the i-th eigenvalue of the input signal and $\overline{\lambda_i^j}$ is the i-th eigenvalue of a codebook in a j-th class.

15. The vector quantization method of claim 11, wherein, in the optimal code vector selection step, a code vector having a minimum distortion is selected as the optimal code vector using $\epsilon=(U^T s^k-\hat{c}_{ij}^{\,k})^T(U^T s^k-\hat{c}_{ij}^{\,k})$ wherein $U^T s^k$ is a k-dimensional KLT-domain signal and $\hat{c}_{ij}^{\,k}$ denotes a j-th codebook entry in the i-th class for $U^T s^k$.

16. The vector quantization apparatus of claims 11, where the dimension of the codebook is reduced to a subset dimension by using the energy concentration property of the KLT.

17. The encoding method of claim 11, wherein the step of transmitting both an index of LP coefficients and the index data of the selected code vector as the vector quantization value.

18. A decoding apparatus for speech signals, comprising:

a codebook group having a plurality of codebooks that store the code vectors for a speech signal obtained by Karhunen-Loéve Transform (KLT), the codebooks classified according to the KLT domain statistics of the speech signal;

a data detection unit for detecting a code vector index from received data, detecting an eigenvalue set and a unitary matrix U from the linear prediction (LP) coefficient representing the spectrum characteristics of a current frame, and outputting the detected code vector index and the detected eigenvalue set to the codebook group; and an inverse KLT unit for performing an inverse KLT operation using the unitary matrix U received from the data detection unit and a code vector detected from the code vector index received from the codebook group, to restore the speech signal corresponding to the detected code vector.

19. A decoding method for speech signals, the method comprising the steps of:

forming a codebook group having a plurality of codebooks that store the code vectors for a speech signal obtained by Karhunen-Loéve Transform (KLT), the codebooks classified according to the KLT domain statistics of the speech signal;

detecting a code vector index from received data, detecting an eigenvalue set and a unitary matrix U from the linear prediction (LP) coefficient representing the spectrum characteristics of a current frame, and outputting the detected code vector index and the detected eigenvalue set to the codebook group; and performing an inverse KLT operation using the unitary matrix U received from the data detection unit and a code vector detected from the code vector index received from the codebook group, to restore the speech signal corresponding to the detected code vector.

* * * * *

UNITED STATES PATENT AND TRADEMARK OFFICE

CERTIFICATE OF CORRECTION

PATENT NO. : 6,631,347 B1
DATED : October 7, 2003
INVENTOR(S) : Moo Young Kim et al.

It is certified that error appears in the above-identified patent and that said Letters Patent is hereby corrected as shown below:

Title page,
Item [73], Assignee, should read -- Samsung Electronics Co., Ltd. (KR)
Global IP Sound AB (SE) --.

Signed and Sealed this

Sixth Day of September, 2005

JON W. DUDAS
*Director of the United States Patent and Trademark Office*